3/25/80 XR 4,194,788

United States Patent [19]

Miller

[11] 4,194,788

[45] Mar. 25, 1980

[54] METHOD OF FORMING A RUBBLIZED IN-SITU RETORT

[75] Inventor: J. Blaine Miller, Englewood, Colo.

[73] Assignee: Gulf Oil Corporation, Pittsburgh, Pa.

[21] Appl. No.: 882,360

[22] Filed: Mar. 1, 1978

[51] Int. Cl.[2] ..... E21C 41/10

[52] U.S. Cl. ..... 299/2; 299/13; 299/19

[58] Field of Search ..... 299/2, 13, 18, 19; 102/23

[56] References Cited

U.S. PATENT DOCUMENTS

| | | | |
|---|---|---|---|
| 3,001,776 | 9/1961 | Van Poollen | 299/2 |
| 4,017,119 | 4/1977 | Lewis | 299/2 |
| 4,106,814 | 8/1978 | French | 299/2 |

OTHER PUBLICATIONS

"SME Mining Engineering Handbook", 12.15—Sublevel Caving, pp. 12-222 to 12-233.

*Primary Examiner*—Ernest R. Purser

[57] ABSTRACT

An in-situ retort is formed in an oil shale deposit by a sublevel caving method in which the starting slot for the sublevel caving is at opposite ends of the retort on adjacent sublevels. Any zones of high permeability that are formed adjacent to the starting slots are limited in vertical extent to the vertical spacing of the sublevels and are spaced from the zones of high permeability in adjacent sublevels by the length of the retort. A source of channeling through the retort that is caused by the usual sublevel caving mining method is thereby eliminated.

15 Claims, 4 Drawing Figures

METHOD OF FORMING A RUBBLIZED IN-SITU RETORT

BACKGROUND OF THE INVENTION

1. Field of the Invention

This invention relates to the retorting of subsurface carbonaceous deposits and more particularly to the construction of a rubblized in-situ retort in such deposits.

2. Description of the Prior Art

In-situ combustion processes have been proposed for the recovery of valuable products, particularly fuels, from underground deposits of carbonaceous deposits such as petroleum, coal, and oil shale. It is necessary in in-situ combustion processes to pass combustion air and products of combustion through the deposit if combustion is to be maintained. Many of the carbonaceous deposits, particularly those of oil shale and coal, have a very low permeability that makes treatment of the deposit to increase its permeability necessary before an in-situ combustion recovery process can be used. One method of increasing the permeability is to rubblize the deposit. Rubblization is particularly valuable in increasing the permeability of oil shale deposits and for that reason this invention will be described with specific reference to oil shale.

Shale oil is recovered from oil shale by heating the oil shale to a temperature above about 800° F. at which kerogen, a solid carbonaceous deposit in the oil shale, is decomposed at the high temperature to yield shale oil. A number of retorting processes have been developed in which oil shale is mined and lifted to the surface where it is passed through retorts to heat the oil shale to a temperature at which shale oil is liberated.

To avoid the high cost of mining oil shale and lifting it to the surface and to eliminate some problems such as disposal of the spent shale, it has been proposed to retort oil shale in-situ in the shale deposit. The heat necessary to cause decomposition of the kerogen in the oil shale is provided by burning a portion of the carbonaceous material in the oil shale. Because of the very low permeability of oil shale and because kerogen is a solid material that cannot be made to flow until heated to a high temperature, it is necessary to rubblize the oil shale before combustion air and hot products of combustion can be made to flow through the shale deposit to heat the oil shale to a temperature at which shale oil is produced. Ordinarily, the rubblized oil shale has a void space of 10 to 30 percent of the volume of the in-situ retort. To avoid channeling through the retort of combustion air injected into the retort for the in-situ combustion with consequent bypassing of oil shale in the deposit, it is important that the rubblization be accomplished in a manner to provide substantially uniform permeability to the flow of gas through the retort.

A number of different mining techniques have been suggested for the rubblization of oil shale deposits to form in-situ retorts having a permeability suitable for the in-situ combustion process. In U.S. Pat. No. 3,001,776 of Van Poollen, it is stated that the retorts can be formed by well-known mining processes such as sublevel stoping, shrinkage stoping, sublevel caving or block caving. Sublevel caving has been recognized as a particularly advantageous method for forming in-situ retorts because of the close control of void space and rubblization and, consequently, permeability of the retort that is possible with that mining method. Sublevel caving involves the formation of a vertical starting slot at one end of the retort or area to be mined. The starting slot provides void space and an exposed surface that allows free face blasting. After blasting which rubblizes a portion of the rock, broken rock is withdrawn and the blasting is repeated. The blasting operation retreats from the starting slot across the zone to be mined, towards a shaft in which the mined rock is lifted to the surface.

In the rubblization of rock to form an in-situ retort, only a portion of the rock broken by the blasting is withdrawn for a subsequent blasting step to provide void space that imparts the desired permeability to the rubblized zone. Sublevel caving is described in detail in the *SME Mining Engineering Handbook*, published by the Society of Mining Engineers of The American Institute of Mining, Metallurgical, and Petroleum Engineers, Inc. in 1973, beginning at page 12-222 and continuing to page 12-233.

One method of utilizing sublevel caving in the formation of an in-situ retort in oil shale is described in U.S. Pat. No. 4,017,119 of Arthur E. Lewis. In that patent, variations in permeability are produced in the rubblized deposit to prevent plugging of the deposit by softened oil shale of high kerogen content. As described in U.S. Pat. No. 4,017,119, the sublevel caving operation is conducted simultaneously at several sublevels of the deposit with the rubblization being most advanced in the upper layer of rubblized oil shale. The starting slot for the mining and rubblization operations at all sublevels is at the same end of the retort, and the mining operations retreat in the same direction on all sublevels.

The blasting of oil shale into the starting slot results in a void space of the rubblized rock in the zone of the starting slot of approximately 40 percent whereas the desired void space in the remainder of the retort is in the range of 10 to 30 percent. The permeability of the rubblized shale in the zone of starting slots is, therefore, substantially higher than the remainder of the retort. Since all of the starting slots for the different sublevels are located at the boundary of the deposit to be mined or the rubblized retort to be formed remote from the shaft through which the mined rock is lifted to the surface, a zone of high permeability extending from the top of the retort to the bottom is formed along that boundary. During subsequent retorting, combustion air will channel through the highly permeable zone and can result in bypassing of substantial shale in the retort.

BRIEF SUMMARY OF THE INVENTION

This invention produces a rubblized retort in an oil shale deposit. A zone of high permeability extending from the top to the bottom of the retort is avoided by excavating the starting slot at each sublevel at the end of the retort opposite the end at which the starting slot was excavated from the next higher sublevel. Thus, the zones of high permeability resulting from the starting slot are at alternate ends of the retort for adjacent layers of oil shale rubblized to avoid the formation of a zone of high permeability extending continuously from the top to the bottom of the retort.

DESCRIPTION OF PREFERRED EMBODIMENT

Figure 1:
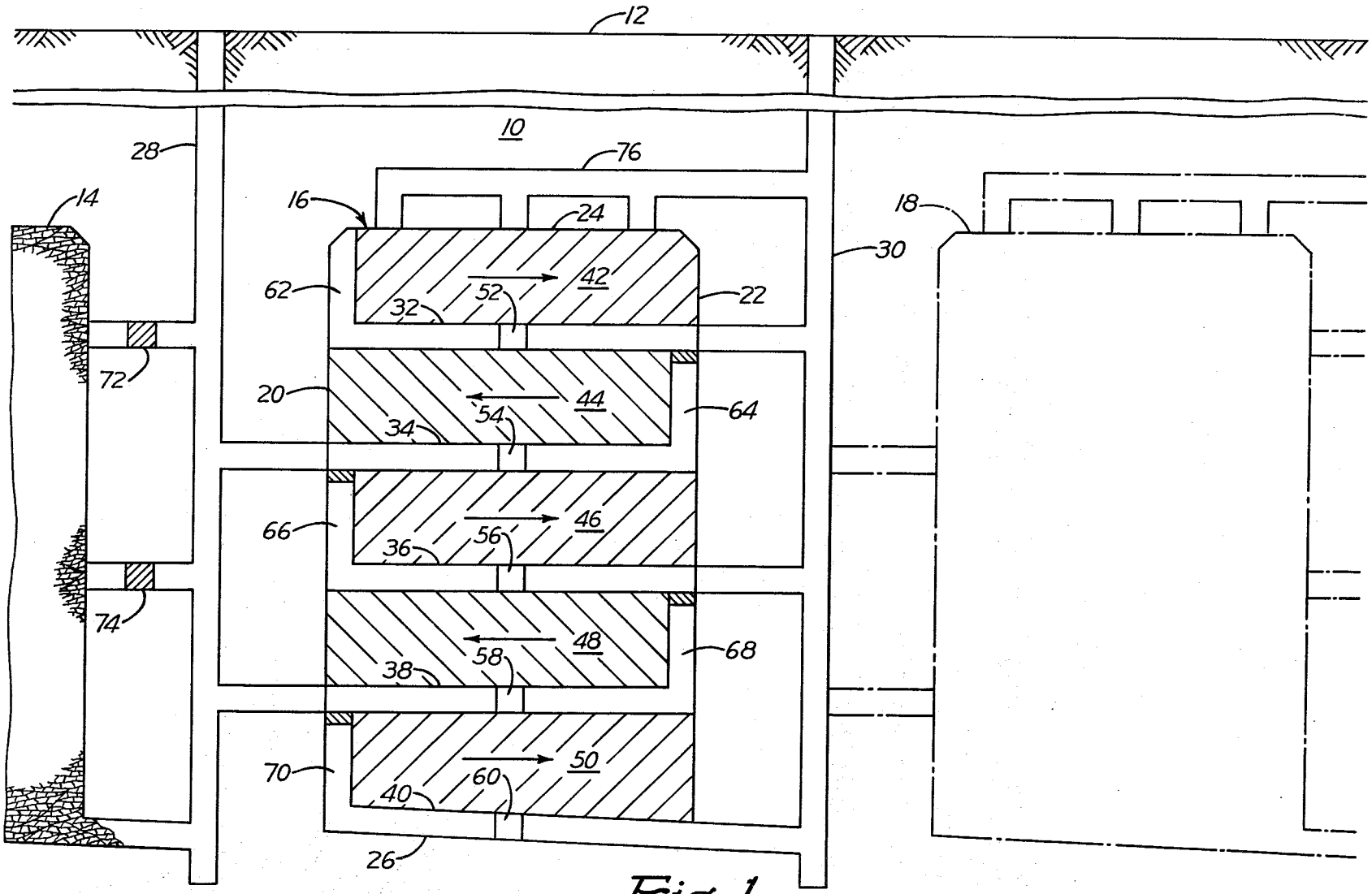
FIG. 1 is a diagrammatic illustration of a preferred embodiment of this invention in which there are shafts positioned at each end of the retort for lifting withdrawn shale to the surface.

Referring to FIG. 1 of the drawings, an oil shale deposit 10 is shown located below the ground surface 12. Previously rubblized retort 14 is shown adjacent a retort 16 in the initial stages of construction according to this invention. At the end of retort 16 opposite retort 14, a future retort 18 is indicated by broken lines. The ends of retort 16 are indicated by lines 20 and 22, the top by line 24 and the bottom by line 26. Those lines show the boundaries that the retort will have when completed. Spaced to the left of end 20 of retort 16 in FIG. 1 is a vertical shaft 28. A similar shaft 30 is spaced from the opposite end 22 of retort 16. Shafts 28 and 30 are for the equipment for lifting oil shale to the surface during the rubblization and for delivering air into the retorts during rubblizing activities.

Figure 3:
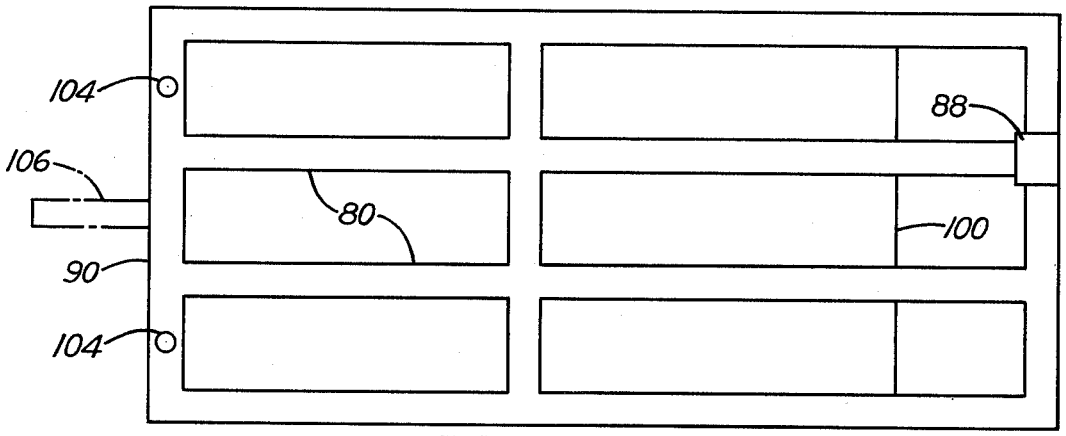
FIG. 3 is a horizontal sectional view along section line III—III in FIG. 2.
Figure 4:
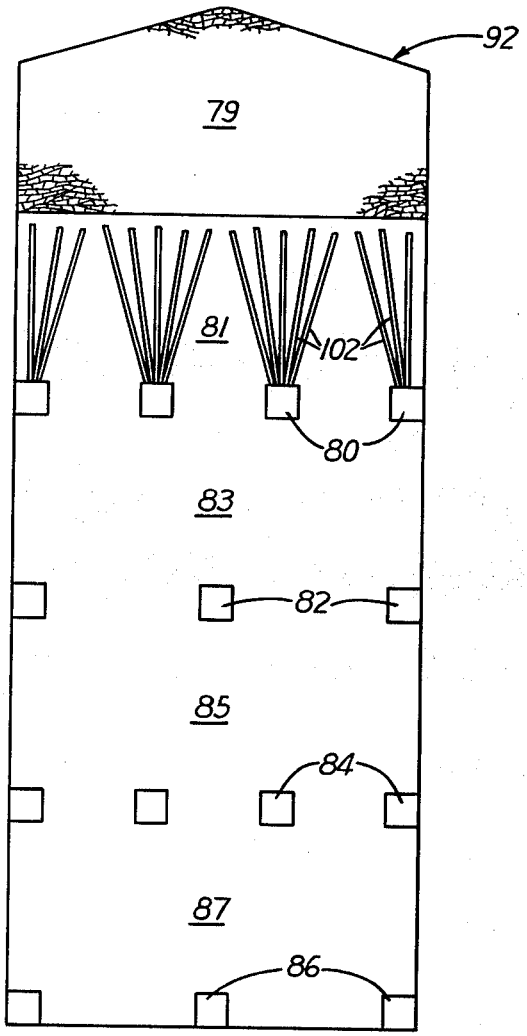
FIG. 4 is a vertical sectional view taken along section line IV—IV in FIG. 2.

Extending longitudinally through the retort 16 are a plurality of vertically spaced-apart withdrawal drifts 32, 34, 36, 38 and 40 at the sublevels at which mining operations are conducted. The withdrawal drifts divide the shale to be rubblized to form the in-situ retort into a top or first layer 42 above the top or first withdrawal drift 32, a second layer 44 immediately below the first layer, and successively lower third, fourth and fifth layers 46, 48 and 50. Because FIG. 1 is a vertical section, a single withdrawal drift is shown at each sublevel. There ordinarily will be a plurality of parallel withdrawal drifts at each sublevel as is shown in FIGS. 3 and 4 for the embodiment illustrated in vertical section in FIG. 2. One or more cross drifts indicated in FIG. 1 by reference numerals 52, 54, 56, 58 and 60 may be provided in each withdrawal drift. The withdrawal drifts at successive sublevels are connected alternately to shafts 30 and 28. As shown in FIG. 1, withdrawal drifts 32, 36 and 40 extend beyond the end 22 of the retort to communicate with shaft 30 and withdrawal drifts 34 and 38 extend beyond the end 20 of retort 16 to shaft 28. Starting slots are excavated in the overlying layer of shale at the distal end of each of the withdrawal drifts relative to the shaft with which the withdrawal drift communicates. Thus, starting slots 62, 66 and 70 are excavated in the first, third and fifth layers from withdrawal drifts 32, 36 and 40, respectively. Starting slots 64 and 68 are excavated at the ends of withdrawal drifts 34 and 38 remote from the intersection of those withdrawal drifts with shaft 28.

In the rubblization of the retort, blasting holes are drilled upwardly from top or first withdrawal drifts 32 into the first layer 42 of oil shale from the withdrawal drifts 32 beginning adjacent starting slot 62 in the conventional manner for sublevel caving mining. After blasting oil shale into starting slot 62, broken shale is withdrawn in an amount designed to give the desired void space in the retort through the withdrawal drift 32 and lifted to the surface through shaft 30. Thereafter, additional vertical blasting holes are drilled upwardly from withdrawal drift 32 into the first layer 42 of shale adjacent the shale rubblized in the first blasting operation and a portion of the rubblized shale withdrawn to provide void space for further rubblization. The procedure of drilling blasting holes, blasting and withdrawing shale is repeated until the entire first layer 42 of shale is rubblized; thus, the rubblization procedure retreats from the starting slot 62 at the end 20 of the retort in the direction of the arrow in the first layer to the end 22 of the retort.

Preferably after rubblization of the first layer is completed, the rubblization of the second layer 44 is begun utilizing the sequence of drilling blasting holes, blasting, withdrawing a portion of the oil shale and repeating the sequence as described for layer 42. The rubblization of the second layer retreats from the starting slot 64 across the second layer in the direction indicated by the arrow until the end 20 of the retort is reached. During this operation, air is supplied through shaft 28 and withdrawn oil shale is delivered to the surface through shaft 28. The sublevel caving rubblization operations are repeated through the third, fourth and fifth layers with the location of the starting slot and the direction of retreat during the rubblization in each layer being opposite that of the immediately preceding layer.

In the preferred operation described with reference to FIG. 1, the rubblization is completed in the top or first layer before being initiated in the second layer and in a like manner successively through the third, fourth and fifth layers to the bottom of the retort. Sublevel caving can proceed simultaneously in more than one layer; however, it would then be necessary to provide a suitable roadway in the withdrawal drift at the end of the retort adjacent the shaft over rubblized shale in the next lower layer as well as suitable support of unbroken shale that overlies rubblized shale. After completion of the rubblization of the retort, the withdrawal drifts are barricaded between the ends of the retort and the intersection with the shafts, as indicated by reference numerals 72 and 74 in the withdrawal drifts between the completed retort 14 and shaft 28. Shaft 30 can subsequently be used for the rubblization of retort 18. Thus, although the embodiment of the invention illustrated in FIG. 1 requires two shafts during the rubblization of each retort, the shafts can be used for the rubblization of more than one retort.

Upon completion of the rubblization, there will be a vertical zone of higher than average permeability in the first layer of rubblized oil shale at the location of the starting slot 62 adjacent end 20 because of the blasting of rock into a completely open space in the first blasting step. Subsequent blasting steps will be into rubblized zones containing rubblized oil shale and void space is essentially between broken pieces of oil shale. While the blasting of oil shale into the open starting slot produces a void space of about 40 percent in the rubble that fills the starting slot, subsequent rubblization at each sublevel can be controlled to produce a void space in the desired range of 10 to 30 percent. There will be similar zones of high void space and permeability at the locations of the starting slots 64, 66, 68 and 70. Because the adjacent zones of high permeability are at opposite ends of the retort, there is not a continuous highly permeable zone extending from the top to the bottom of the retort.

A typical retort for the production of oil from oil shale will be approximately 300 feet long and 150 feet wide. It may have a height of 750 feet or more depending upon the particular oil shale deposit. It is apparent that each zone of relatively high permeability will be separated from the zone of high permeability in the adjacent layer by substantial distance. Any tendency to flow from a zone of high permeability in one layer to a zone of high permeability in the next layer would have the effect of increasing the uniformity of flow through the rubblized in-situ retort because of the repeated redistribution of flow caused by the cross-flow. Moreover, the permeability of the oil shale immediately below a zone of high permeability resulting from the starting slots can be made higher than average during construction of the retort by control of the amount of oil shale withdrawn prior to the last blasting at each sublevel.

A combustion of air supply tunnel 76 is driven from shaft 30 to communicate with the top of the retort. Retorting of the rubblized oil shale is conducted by conventional techniques such as those disclosed in the Van Poollen U.S. Pat. No. 3,001,776, for example. In a preferred process, combustion air and a fuel are supplied through combustion air supply tunnel 76 into the top of the retort. The fuel is ignited and burned in the retort. Combustion products travel downwardly through the rubblized retort to the bottom of the retort and are delivered through a suitable tunnel such as the bottom withdrawal drift 40 into a shaft for lifting to the surface. The burning of the fuel is continued until shale at the top of the retort is heated to a temperature at which burning of carbonaceous material in the shale will support the combustion and thereafter the supply of fuel is terminated, but the delivery of combustion air is continued. Hot products of combustion that travel downwardly from the combustion front through the shale convert kerogen below the combustion front into shale oil which drains to the lower end of the retort for delivery to the surface. Immediately below the combustion front carbonaceous material remaining on the oil shale is coked by the high temperature. That coke supplies the fuel that maintains combustion and thereby supplies the heat for the retorting operation. Although downward in-situ combustion is a preferred retorting process, the rubblized shale in the retort may be retorted by other processes, such as upward burning or injection of hot retorting gases, if desired.

Figure 2:
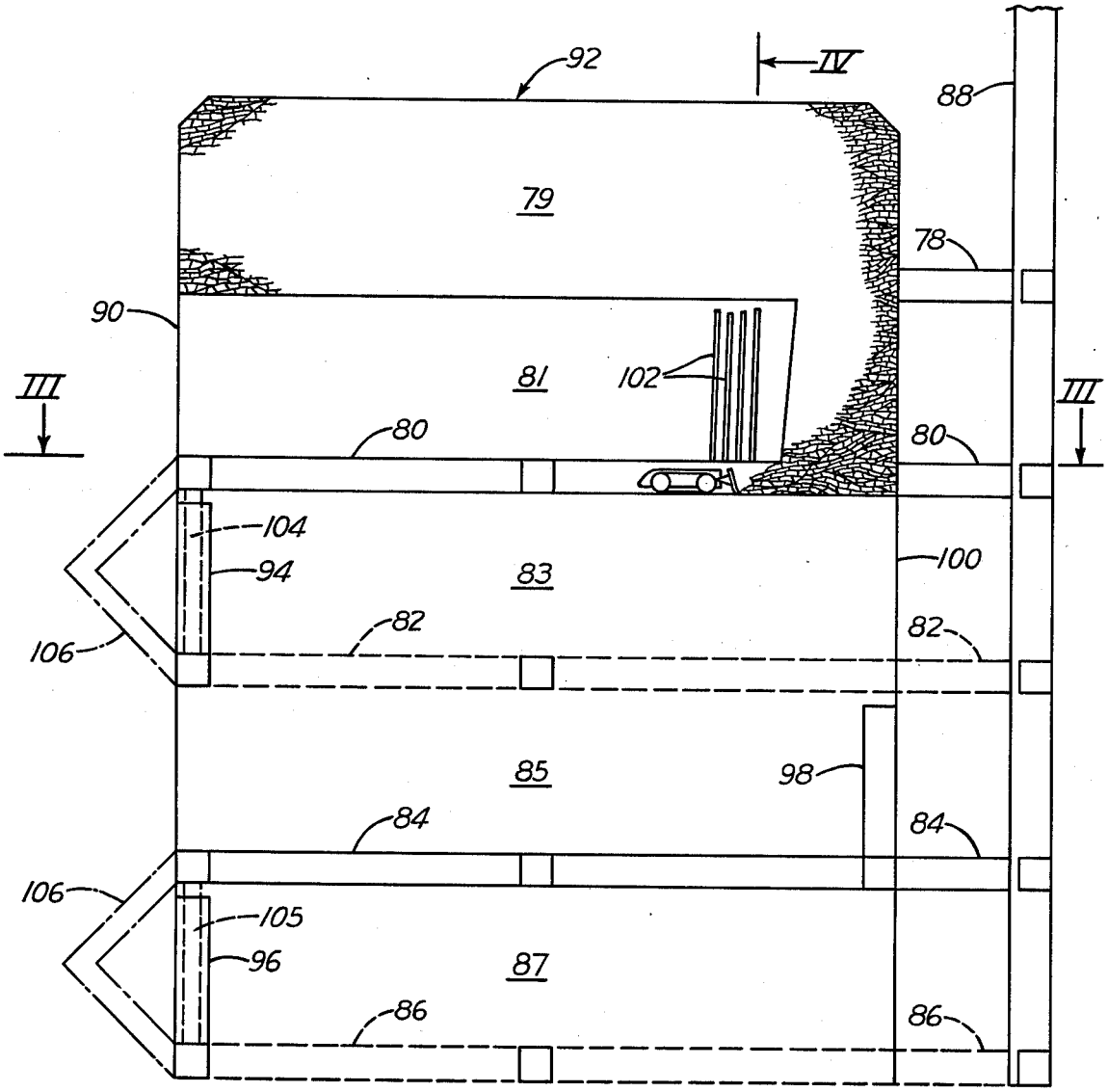
FIG. 2 is a diagrammatic vertical sectional view of a retort at an intermediate point in the rubblization in which all of the shale withdrawn during the rubblization is delivered to one end of the retort for lifting to the surface.

In the embodiment of the invention illustrated in FIG. 2, a single shaft is used to supply air and lift withdrawn oil shale during the rubblization. In that embodiment, first, second, third, fourth and fifth withdrawal drifts 78, 80, 82, 84 and 86 are driven from a shaft 88 to the distal end 90 of a retort indicated generally by reference numeral 92 to divide the deposit into a first layer 79 at the top of the retort and successively lower layers 81, 83, 85 and 87. Starting slots are excavated at the distal ends of withdrawal drifts 78, 82 and 86 into the overlying layer of oil shale. The starting slots at the ends of withdrawal drifts 82 and 86 are indicated by reference numerals 94 and 96. The starting slot at the end of drift 78 has been filled by rubblized shale during the rubblization of the first layer of oil shale. A starting slot 98 at the near end 100 of retort 92 is driven from withdrawal drift 84 upwardly into the overlying layer of shale. A similar starting slot at the near end 100 of the retort has been driven upwardly from withdrawal drift 80 into the overlying layer of shale but that slot is filled with rubblized shale at the stage of the operations indicated in FIG. 2.

The rubblization of retort 92 is accomplished by sublevel caving from withdrawal drift 78 beginning at the starting slot, not shown, originally extending upwardly from the end of the withdrawal drift at the remote end 90 of the retort and retreating from remote end 90 toward the near end 100 of the retort to rubblize the first or top layer 79 of oil shale. Upon completion of the rubblization of the first layer 79, blasting holes are drilled upwardly from withdrawal drift 80 adjacent the starting slot, not shown, extending upwardly from the withdrawal drift 80 into layer 79 and oil shale is blasted into the starting slot. Thereafter, blasting holes indicated in FIG. 2 by reference numeral 102 are drilled from withdrawal drift 80 upwardly into the second layer of oil shale and the shale blasted into the void that has been formed by withdrawing part of the rubblized oil shale produced by blasting into the starting slot. Oil shale withdrawn is hauled through withdrawal drift 80 to the distal end and dropped through a rock pass 104 to the next lower withdrawal drift and hauled through that drift to the shaft 88. Air is supplied to the retort through drift 82 and rock pass 104 during rubblization of layer 81. The rubblization of the second layer 81 of oil shale proceeds from right to left in FIG. 2. After drilling of the last blast holes for rubblization of the second layer, the equipment can either be lowered to the next layer through the rock pass 104 or transferred to the next lower layer through access tunnels 106. The third layer 83 is then rubblized by sublevel caving beginning at slot 94 and retreating across the retort to the near end 100 of the retort. Air is supplied during that phase of the operation through withdrawal drift 82 and withdrawn rock is delivered to the shaft through that withdrawal drift. Layer 85 is rubblized in a manner similar to layer 81 and withdrawn shale is dropped through rock pass 105. Rubblization of layer 87 proceeds as in layers 79 and 83.

The rubblization method described herein has the advantages of sublevel caving in allowing control of the void space and the rubblization of the rock into particles of substantially uniform size while eliminating a zone of high permeability extending continuously from the top to the bottom of the rubblized rock. The method is particularly useful in the construction of rubblized retorts in oil shale for the production of shale oil by in-situ combustion, but can also be used for the production of heavy, highly viscous petroleum oils in reservoirs of low permeability by thermal stimulation and for in-situ gasification of coal.

I claim:

1. A method of constructing a rubblized in-situ retort in a subsurface deposit of a carbonaceous material for the in-situ retorting of the deposit to produce a fluid fuel comprising driving through the deposit a plurality of vertically spaced, substantially horizontal withdrawal drifts, said drifts extending the full horizontal length of the desired in-situ retort to divide the retort into a plurality of superposed layers of the deposit, excavating a first starting slot extending upwardly from the top drift into the top layer of the deposit at one end of the retort, rubblizing the deposit in the top layer by sublevel caving starting at the starting slot and retreating toward the opposite end of the retort, excavating a second starting slot extending upwardly from the second drift into the second layer of the deposit at the end of the retort opposite from the first starting slot, rubblizing the deposit in the second layer by sublevel caving starting at the second starting slot and retreating in the direction opposite the direction followed in rubblization of the first level, and repeating the excavating of starting slots and rubblization by sublevel caving in successively lower layers of the retort until the retort is rubblized for the desired height, the location of the starting slot and the direction of retreat during the sublevel caving in each layer being opposite the location of the starting slot and the direction of retreat in the layer immediately above.

2. A method as set forth in claim 1 characterized by the deposit being oil shale.

3. A method as set forth in claim 1 characterized by the deposit being a petroleum reservoir.

4. A method as set forth in claim 1 characterized by the deposit being coal.

5. A method as set forth in claim 1 characterized by the sublevel caving operation being performed in the top layer first and being completed in each layer before being started in the next lower layer.

6. A method as set forth in claim 1 characterized by the sublevel caving proceeding simultaneously in a plurality of layers.

7. A method of constructing an in-situ retort in a subsurface deposit of a carbonaceous material for the in-situ retorting of the deposit comprising driving first vertical shaft means into the deposit spaced from one end of the retort for the delivery of air to and withdrawal of the deposit from the retort, driving second shaft means from the surface into the deposit spaced from the opposite end of the retort for the delivery of air into and withdrawal of the deposit from the retort, driving spaced-apart, substantially horizontal withdrawal drifts from the first shaft means toward the second shaft means and terminating at the end of the retort adjacent the second shaft means, driving withdrawal drifts from the second shaft means through the deposit toward the first shaft means and terminating at the end of the retort adjacent the first shaft means, the withdrawal drifts from the second shaft means being vertically spaced from and alternating with the withdrawal drifts from the first shaft means to divide the retort into a plurality of superposed layers with the top withdrawal drift extending from the first shaft means, excavating a first starting slot in the first layer extending upwardly from the top withdrawal drift at the end of the retort opposite the first shaft means and withdrawing the excavated deposit to the first shaft means for delivery to the surface, sublevel caving the first layer of the deposit retreating from the first slot toward the first shaft means to rubblize the first layer of the deposit, excavating a second starting slot extending upwardly into the second layer from the second withdrawal drift at the end of the retort adjacent the first shaft means and delivering withdrawn deposit through the second withdrawal drift and the second shaft means to the surface, sublevel caving the second layer of the deposit while retreating from the second slot toward the second shaft means to rubblize the second layer of shale, and repeating the excavation of the starting slot and sublevel caving in successively lower layers of the deposit until the bottom of the retort is reached with the location of the starting slot and the direction of retreat in each layer being opposite the location of the starting slot and the direction of withdrawal in the layer immediately above.

8. A method as set forth in claim 7 characterized by the deposit being oil shale.

9. A method as set forth in claim 7 characterized by the deposit being a petroleum reservoir.

10. A method as set forth in claim 7 characterized by the deposit being coal.

11. A method of constructing a rubblized in-situ retort in a deposit of a carbonaceous material for the retorting of the deposit to produce a fluid fuel comprising drilling a shaft from the ground surface into the deposit at a location adjacent but spaced from one end of the desired retort, driving a plurality of vertically spaced-apart withdrawal drifts from the shaft to the end of the retort remote from the shaft to divide the retort into a plurality of superposed layers, excavating from the first withdrawal drift a starting slot in the first layer at the end of the retort remote from the shaft and rubblizing the first layer of the deposit by sublevel caving while retreating from the starting slot toward the shaft, excavating from the second withdrawal drift a starting slot in the second layer of the deposit at the end of the retort nearest the shaft, driving an opening connecting the second withdrawal drift with the third withdrawal drift at the end of the retort remote from the shaft, rubblizing the second layer of the deposit by sublevel caving while retreating in a direction opposite the direction of retreat during rubblization of the first layer, dropping withdrawn deposit removed during sublevel caving of the second layer to provide void space in the rubblized deposit through the opening from the second drift to the third drift, and repeating the sequence of cutting a slot and rubblizing by sublevel caving through each of the layers until the bottom of the retort is reached with the location of the starting slot and the direction of retreat in each layer being opposite such location and direction of retreat in the layer immediately above, and dropping deposit withdrawn from each layer rubblized while retreating toward the end of the retort remote from the shaft to the next lower withdrawal drift for delivery to the shaft and lifting to the surface.

12. A method as set forth in claim 11 characterized by the deposit being oil shale.

13. A method as set forth in claim 11 characterized by the deposit being a petroleum reservoir.

14. A method as set forth in claim 11 characterized by the deposit being coal.

15. A method of constructing an in-situ retort in a carbonaceous slot comprising excavating from each of a plurality of vertically spaced withdrawal drifts a starting slot extending upwardly into the layer of carbonaceous deposit overlying each of the withdrawal drifts, the slot at each withdrawal drift being at the end of the retort opposite that at which the slot from the adjacent withdrawal drift is located, rubblizing the carbonaceous deposit in each layer by sublevel caving starting at the starting slot and retreating across the retort to the opposite end of the retort, and withdrawing a smaller amount of deposit prior to the last blasting step in the sublevel caving from each withdrawal drift other than the top withdrawal drift than is withdrawn prior to previous blasting steps whereby a zone of low permeability is formed below the location of each starting slot.

* * * * *